US006682781B2

(12) United States Patent
Hoogen et al.

(10) Patent No.: US 6,682,781 B2
(45) Date of Patent: Jan. 27, 2004

(54) DEVICE AND METHOD FOR WETTING FLEXIBLE MAT-SHAPED CARRIER MATERIALS

(75) Inventors: Norbert Hoogen, Kleve (DE); Dieter Lencer, Wegberg (DE); Christoph Pekal, Krefeld (DE)

(73) Assignees: Heidel GmbH & Co. KG, Viersen (DE); Werkzeug - u. Maschinenfabrikation, Viersen (DE)

( * ) Notice: Subject to any disclaimer, the term of this patent is extended or adjusted under 35 U.S.C. 154(b) by 79 days.

(21) Appl. No.: 10/075,349

(22) Filed: Feb. 14, 2002

(65) Prior Publication Data

US 2002/0139299 A1 Oct. 3, 2002

Related U.S. Application Data

(62) Division of application No. 09/577,553, filed on May 24, 2000, now Pat. No. 6,408,785.

(30) Foreign Application Priority Data

| | | |
|---|---|---|
| Oct. 11, 1999 | (DE) | 299 17 899 |
| Nov. 3, 1999 | (EP) | 99120964 |
| Nov. 19, 1999 | (DE) | 299 20 322 |

(51) Int. Cl.[7] ..... B05D 1/02; B05D 7/22

(52) U.S. Cl. ..... 427/421; 427/230; 427/236; 427/424

(58) Field of Search ..... 427/421, 424, 427/425, 230, 233, 236, 209; 118/300, 305, 306, 307, 500, 503, 33, 622, 317, 323; 134/167 R, 168 R, 201; 156/129, 227, 226; 269/257, 136; 68/205 R

(56) References Cited

U.S. PATENT DOCUMENTS

| | | | | | |
|---|---|---|---|---|---|
| 4,923,743 | A | * | 5/1990 | Stewart, Jr. | 427/288 |
| 5,665,444 | A | * | 9/1997 | Eguchi et al. | 428/36.91 |
| 6,018,859 | A | * | 2/2000 | Borzym et al. | 29/458 |

FOREIGN PATENT DOCUMENTS

| | | |
|---|---|---|
| DE | 196 33 656 C1 | 3/1998 |
| DE | 4441838 | 4/1998 |

* cited by examiner

*Primary Examiner*—Timothy Meeks
*Assistant Examiner*—Eric B Fuller
(74) *Attorney, Agent, or Firm*—Friedrich Kueffner

(57) ABSTRACT

A wetting device for the mat (10) of a carrier material comprises a grasping frame which is constituted by side ledges (101, 102, 104), whereby the mat to be coated (10) can be fixed by clamps (105) to the side ledges. At least one of the side ledges of the frame is configured flexible (bendable), since it preferably comprises several segments (101, 102) which are hinged together. Thus, the clamped mat (10) can be brought into a cylindrical configuration in which it can be coated by a spray device which is introduced into the inner space of the cylinder. Due to the subsequent bending of the flexible side ledge in the opposite direction, the mat (10) can be brought into a second cylindrical configuration for which its other upper surface constitutes the inner side of the cylinder and is thus available for being coated by the spray device. During the spraying operation, the cylinder axis is preferably orientated vertically in order to avoid non-homogeneities of the coating because of the gravitation.

4 Claims, 6 Drawing Sheets

DEVICE AND METHOD FOR WETTING FLEXIBLE MAT-SHAPED CARRIER MATERIALS

This application is a divisional of application Ser. No. 09/577,553, filed May 24, 2000, now U.S. Pat. No. 6,408, 785B1.

This invention relates to a device for wetting a flexible mat-shaped carrier material comprising guiding elements for the transport and guiding of the carrier material configured in such a way that at least one hollow space limited by the carrier material is constituted into which a spray device can be introduced for wetting the upper surface of the carrier material which is turned to the inner side of the hollow space. Furthermore, the invention relates to a method for wetting a flexible mat-shaped carrier material in which the carrier material is guided by constituting at least one hollow space and the upper surface of the carrier material which is turned to the inner side of the hollow space is wetted.

A device and a method of the above mentioned type are known, among others, from DE 196 33 656 C1. For the carrier materials, they can be, for example, nonwovens and fiber mats made of plastics, glass fibers and natural fibers, whereby these materials can exist as primary raw materials as well as as recycled materials or as a mixture thereof. Such carrier materials must often be provided with a stiffening matrix material by spraying on liquid existing components. For the liquid existing components, they are generally two-component resins, for example polyurethane resins, epoxy resins and the like. Due to the adhesive effect and the curing process, there result moulded parts with an inherent stability which can be used, for example, in the automotive industry, in the furniture industry and for consumer goods.

For the device for wetting such mat-shaped carrier materials according to DE 196 33 656 C1, a continuous carrier material web is guided over deflection rollers as well as a chain conveyor guide through a wetting device in which it can be wetted on both faces. For this purpose, the carrier material web is guided over two parallel tunnel chain wheels so that it constitutes the surface area of a cylindrical hollow space (tunnel, drum) between these wheels. The inner side of this surface area is then sprayed with the wetting agent and thus wetted on one face. The losses and emissions of the wetting agents to the outside are limited by the fact that the wetting takes place in the inner part of a hollow space. For the double faced coating of the carrier material web, a second pair of tunnel chain wheels is placed in the wetting device by means of which a second cylindrical (tunnel-shaped) hollow space is constituted. Hereby, the inner side of the surface area of the hollow space is however constituted by the other face of the carrier material, i.e. the face which is not yet wetted. Thus, the second side of the carrier material can also be wetted in this second hollow space.

Moreover, methods are known for which two carrier material mats are simultaneously worked, since they constitute together a hollow space for wetting because of corresponding guides. Here, a double-faced coating can also be achieved by turning the two mats.

The so-called high-pressure spray technique constitutes a further state of the art. Wetting agent spray mist is produced here with high pressure and with a relatively high flow rate of additional air. High-pressure spray heads work with an admission pressure up to 80 bar and also use this high pressure for a hydrodynamic mixing effect in the spray head.

The spray heads are most of the time guided by a robot. The output of such systems reaches 2 to 3 $m^2$/min (one-faced) depending on the precision requirements. Since this method is very flexible to use because of the free programmability and is variable with respect to the quantities to be sprayed, it requires high investment costs and a high regular expenditure of cleaning which reduces the daily availability of the system. Furthermore, the system requires much space for the equipment for a relatively low output per area unit. The high overspray quantities, i.e. the quantities of wetting agent which do not reach the aimed place and are sprayed lost in the environment, are also disadvantageous. Finally, there also result high waste quantities of production auxiliary materials, such as for example covering foils.

For the roller-laminating methods, wetted spreader rolls apply the wetting agent onto the carrier materials. Herbey, there does not result or there only results little overspray and only a slight pollution of the ambient air. Moreover, these methods achieve a high output per area unit but cause considerable pollution problems in the installation.

Furthermore, linearly guided spray heads in spray tunnels are known. These spray heads require slightly less investment costs and less installation surfaces than the high-pressure spray technique for the same output per area unit. They can also be compared to those with respect to their daily availability and the secondary waste quantities. The spray systems can work with or without air ("airless").

Concerning the airless methods, spray heads with a mechanical compulsory mixer have been developed which can be operated with relatively low media admission pressure up to 15 bar and only very low quantities of additional air (Tartler company, Lützelbach, Germany). In a certain embodiment, a spray head with a centrifugal wheel is provided with a continuous rotary axle which is preferably screw-shaped for the transport of the wetting agent to its front end. At the front end of the axle, there is a centrifugal disk with a diameter of a few centimeters. The screw and the centrifugal disk rotate at work with numbers of revolutions up to 4000 revs./min. Due to the impact of the wetting agent onto the centrifugal disk, the wetting agent is centrifuged because of the centrifugal forces radially outwards where it reaches the object to be wetted. For wetting carrier materials in the mat cut-out piece with such a device, the mat can be fixed on the inner wall of a rotary drum. The mat upper surface turned to the inner side of the drum can then be wetted by the above described centrifugal wheel spray head. With this method, only one-faced wetting of the carrier materials is possible, since the inner side of the drum would be contaminated by the already wetted upper surface of the carrier material if the mat would be used turned in the drum. Since the wetting agents often are resin components and thus substances which can also be used as adhesives, the contamination of wetting installations with the wetting agent constitutes a particular problem.

It is a disadvantage of the above mentioned "drum wetting methods", among others, that, when the installation is being switched off, they leave either only partially wetted raw mats (i.e. wetted on one face), or they require a relatively high expenditure of technique in order to avoid this. For example devices for the "self threading" of the mat ends must be provided for. If two mat webs have to be worked simultaneously, due to the double layout of machine parts (unwinding, drying, material storing, discharging device, assembling device), this causes relatively high investment costs which can only be defended for an utilization of the very high possible output.

Furthermore, a non-homogeneity of the wetting result appears with the known drum wetting methods, when a horizontally guided centrifugal spray device is introduced into the hollow space (drum, tunnel).

Finally, with the methods with a chain or toothed disk guiding, the fault is found that they have practically no flexibility with respect to the variation of the cut-out dimension of the raw mat, which is however often desired for an optimization of the production.

The aim of this invention was to improve a device of the type mentioned above in such a way that its construction is simpler and that it can thus be produced with less costs, that the coating result is homogeneous and that cut-out dimensions as different as possible can be flexibly worked.

Accordingly, it is the question of a device for which, similarly to the "drum wetting methods", a flexible mat-shaped carrier material is formed over guiding elements in such a way that a hollow space is created which is limited by the carrier material, hollow space into which a spray device can be introduced for wetting the inner side of the hollow space. According to the invention, the transport and guiding elements are constituted by a frame with side ledges in which a carrier material mat can be clamped, whereby the frame has at least one flexible side ledge which can be brought from the stretched form into a bent form (curved, buckled form) and back.

The device according to the invention thus realizes the transport and the configuration of a hollow space from the carrier material mat according to another principle than that of the prior art. Not an (endless) web of carrier material mats is transported and, due to a corresponding web guiding, the intermediate configuration of hollow spaces is provided for, but a single carrier material mat is first firmly tentered into a frame. The frame constituted by side ledges limits a surface, the size of which corresponds to the size of the mat, or the size of which is preferably somewhat bigger than the mat surface. A mat to be coated can then be gripped in the frame surface by means of appropriate retaining means such as, for example, clamps or hooks which are fixed to the side ledges of the frame. A mat which is placed in the frame in this way can be moved together with the frame at will and can especially be transported from a mat distribution station to a coating station and from there to a further processing station, for example to a press. The peculiarity of the frame consists in the fact that at least one side ledge is flexible. This means that it can be brought from the stretched, straight form to a curved or buckled form and back. Hereby, the side ledge can be continuously bendable like a metal wire but can also consist of rigid segments which are articulated the one with the other so that a polygonal tension is created by bending the side ledge. Due to the bending of the flexible side ledge, it is possible to bring the frame which is flat at the beginning with an even frame surface into a three dimensional form which substantially corresponds to a bent cylinder wall (with a circular or polygonal base). Thus, due to the bending of the side ledge, a hollow space is constituted by the carrier material mat clamped in the frame, hollow space into which a spray device can be introduced in a known way for wetting the inner upper surface of the hollow space. Compared with the spraying of an even surface, the constituting of the hollow space has the advantage that coating means losses are minimized due to the fact that the carrier material runs all round as far as possible.

The carrier frame which is used according to the invention has a considerably simpler construction than devices known from the prior art. A corresponding coating device can thus be produced with less costs. Furthermore, the mat cut-out can be variably held in certain limits, since mats of different sizes can be held on the side parts of the frame by fixing clamps with a different length or, due to a movable construction of an articulated arm, the distance between the clamps on the lateral articulated arms can be varied. The device according to the invention thus allows mat size variations up to 10% in both cut-out directions without any problem. Different cut-outs can even be alternately transported within these limits, for example for the front doors and the back doors of a vehicle. Hereby, the machine technical variations for a change of the cut-out size are automatizable. A further advantage of the device according to the invention consists in the fact that this device can be made with a considerably compacter construction, i.e. it requires less space than known devices.

The flexible side ledge can be brought into a curved form towards both sides of the frame surface. This means that the flexible side ledge can also take the curvature which is mirror-inverted to the first curvature. In this way, the invention achieves that a mat which is placed into the frame can constitute two different hollow spaces for which respectively another upper surface of the mat constitutes the inner side. Due to a curvature of the flexible side ledge into the first curvature direction and then into the second curvature direction, the clamped carrier material mat can be coated on both faces the one after the other.

A double-faced coatability of the carrier material mat could principally also be obtained by two different groups of flexible side ledges, whereby the first group guarantees the constitution of a hollow space with a first upper surface of the mat as an inner side and the second group a curvature by constituting a second hollow space for which the second upper surface of the carrier material mat forms the inner side. However, it is simpler for the construction to work with only one group of flexible side ledges and to configure these side ledges bendable in two directions. Such an arrangement also has the advantage that the coating of both hollow spaces can be carried out by the same spray device without complicated manipulations.

The side ledge can, consist of several (rigid) segments connected with each other by hinged articulations. Such an assembly is easy to construct and guarantees a high frame stability since the articulations and the hinges can be constituted with pratically any stability without this being detrimental to an easy bendability of the side ledge. Furthermore, the setting angles of the hinges can be easily controlled so that the movement and conformation of the frame can be automatized.

In a further development of the invention, the whole frame is movably arranged, whereby it is preferably swivellable between at least one position with a horizontally orientated frame surface and at least one position with a vertically orientated frame surface. Due to the movability of the whole frame, the mat can be moved from a reception location to a coating station and from there to a further processing unit, for example to a compacting station. Since mats made of the carrier materials to be coated are generally supplied in the horizontal position, it is advantageous to be able to bring the frame into a horizontally orientated position for receiving and for clamping a mat. Moreover, it is advantageous to be able to bring the frame afterwards into a vertical position in which, due to a corresponding curvature of the flexible side ledge, a substantially cylindrical hollow space with a vertical axis can be constituted. For in this case, the spray device can be introduced into the hollow space along the vertical axis. This orientation of the spray device has the advantage that the effect of gravitation onto the spray mist does not cause an inhomogeneous coating result on the mat. Relating to the direction of the gravitation, the orientation of the vertical hollow space is symmetrical. This means a further advantage compared with the prior art for which only horizontally orientated hollow spaces (tunnels) are known in which, because of the gravitation, the respectively lower tunnel half is provided with a stronger coating.

The change in shape of the flexible side ledge preferably takes place, over a driving motor and a corresponding gear. A determined curvature can be adjusted by means thereof in a simple manner, and the whole coating process can thus be automatized.

Furthermore, the invention relates to a method for wetting a flexible mat-shaped carrier material for which the carrier material is transported by constituting at least one preferably cylindrical hollow space and the upper surface of the carrier material orientated to the inner side of the hollow space is wetted. This method is characterized in that a carrier material mat is tentered onto a carrier frame and the hollow space is formed by bending a flexible side of the carrier frame.

Such a method has the advantage that the mat to be coated can be fixedly clamped into a carrier frame and that no expensive means have to be provided for threading and for a stable guiding of the mat during the transport. The mat which is placed in the carrier frame can rather be manipulated in a simple way with the whole carrier frame or over the carrier frame. By bending a flexible side of the carrier frame, the mat to be coated can be so formed that it constitutes a preferably cylindrical hollow space. This hollow space can then be used in the known manner to coat the inner side of the hollow space with a spray device with as less losses as possible. The method according to the invention is preferably to be carried out with a device of the type explained above.

The method can be further developed in such a way that two hollow spaces are formed the one after the other by two opposite curvatures of the flexible side of the carrier frame, the inner side of the hollow spaces being respectively constituted by different upper surfaces of the carrier material mat. In this way, a mat can be coated on both sided without requiring further complicated steps except the bending up of the flexible side of the carrier frame from a positive to a negative curvature.

The method according to the invention is preferably constructed in such a way that the axis of the constituted hollow space is orientated vertically. This has the advantage that the gravitation acting onto the spray mists of the spray device cannot result in non-homogeneities of the coating on the mat, since no place of the mat is preferentially orientated with respect to the gravitation.

The invention will be explained as an example hereunder with reference to the attached drawings.

Figure 2:
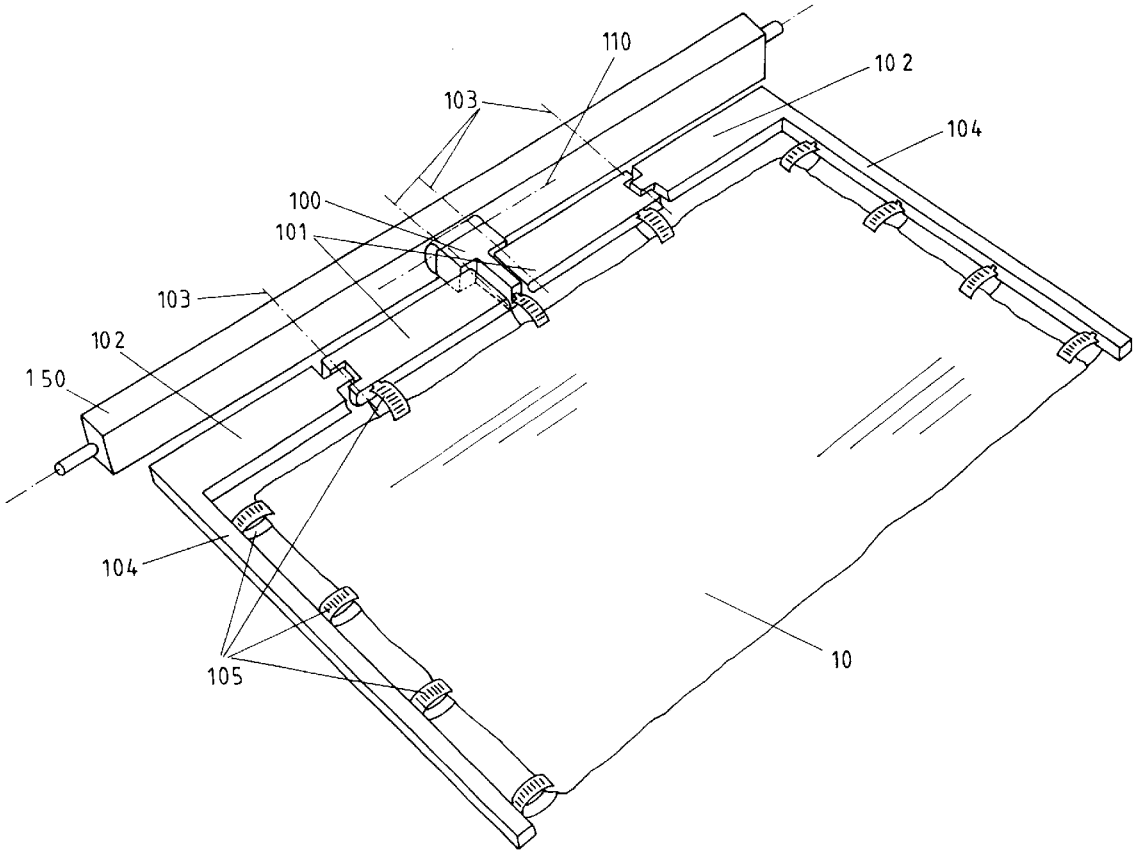
FIG. 2 is a perspective view of the frame with a clamped mat in the flat stretched state.

The explanation of the invention will first begin with FIG. 2. In this figure, an U-shaped frame which is formed by the side parts 104, 102 and 101 can be seen. This frame and the side parts are also designated as "drum gripping frame" or "grasping frame" or "grapplers".

A fiber mat 10 to be coated is clamped into the frame with the clamps 105. The clamping of the mat 10 preferably takes place by the taking over of a raw mat cut-out piece from a supplying table, preferably from an even elevating platform. The clamping will be released again only with the definitive transfer of the impregnated mat to the succeeding pressing tool. This means that the mat is advantageously uninterruptedly fixed and that no interconnected transfer processes take place so that a high safety of the process is guaranteed. During the transfer, the gripping frame can also be used as a tentering frame in order to support a wrinkle-free deformation process. Thus, a particular transfer handling with tentering frame function is not necessary.

Moreover, it can be seen in FIG. 2 that the median side ledge of the U-shaped frame is constituted by four individual segments 102, 101 which are connected with each other over hinged articulations 103. So, it is possible to U-bend the segments 102, 101 against each other and thus to give a curved shape to the corresponding flexible side ledge of the frame. The curved shape can be seen, for example, in FIG. 3.

The flexible side ledge constituted by the segments 101 and 102 is connected over a swinghead 100 with a support 150 for the swinghead. The frame as a whole can be swivelled over a movement of the swinghead 100 and can, in particular, be transferred from the (represented) horizontal position into a vertical position. The drum gripping frame according to the invention can be placed on a robot as well as on multi-axle linear and articulated handlings.

Figure 3:
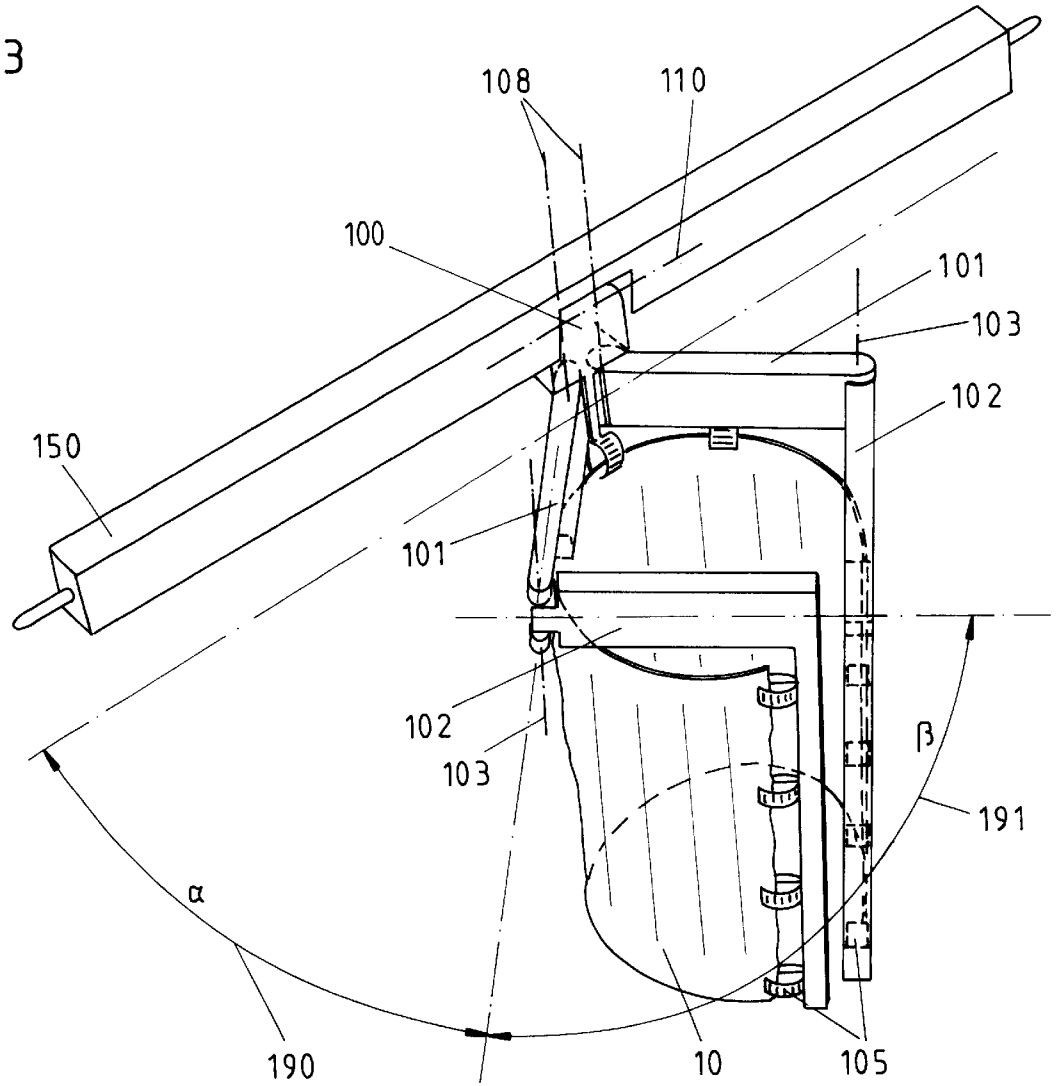
FIG. 3 is a perspective view of the frame with a clamped mat by constituting a hollow space.

A vertical positioning of the carrier frame and thus of the placed mat 10 can be seen in the perspective view of FIG. 3. In this figure, the support 150 is represented in the same position as in FIG. 2, while the orientation of the frame has been changed due to a swivelling movement of the swinghead 100 around the swivelling axles 108, 110. This variation consists for one part in that the frame surface is now orientated vertically downwards away from the support. However, on the other hand, the flexible side ledge of the frame has also been brought through right-angled buckling at the hinges 103 and 108 from the stretched form into the shape of a (near) closed quadrangle. This four-square shape results in that the flexible mat 10 tentered into the frame takes a drum-shaped or cylindrically curved shape, whereby the axis of the cylinder is perpendicular. Moreover, in the figure, an angle □ of approximately 45° and an angle □ (=2×□) which illustrate the swivelling range of the grapplers 101, 102.

The position of the frame and of the mat 10 represented in FIG. 3 represents the wetting position. In this position, a spray head (not represented) can be introduced from the top or from below in vertical direction into the hollow space constituted by the mat 10 and can thus coat the inner side of the mat by radial spraying of the coating agent (see below FIG. 1).

The swing angle range of the hinges 103 allows that the flexible side ledge can also be angled or bent into the opposite direction. This means that the frame can also take a configuration which is mirror-inverted to that represented in FIG. 3 (relating to a surface plane containing the support 150 and the swivelling axis 108). Because of the simple reversible swivelling of the grapplers, the mat is thus bent over the stretched normal position to the other side and formed again to a spherical cylinder. Due to the transfer of the carrier frame into this mirror-inverted position, a second hollow space can be constituted by the mat 10, this second hollow space being different from the first hollow space (FIG. 3) in that the other upper surface of the carrier mat 10 constitutes the inner side of this hollow space. By introducing the spray device again into the second hollow space, the other side of the carrier mat 10 can also be coated, if desired. This double faced coating of the mat 10 is possible without complicated movements of the mat and manipulations of the spray device. Due to a corresponding rotatability of the swinghead 100 about 180° around the vertical axis, the mirror-inverted second hollow space can also be spatially positioned at the same place as the first hollow space. This has the advantage that the spray device can be lowered respectively at exactly the same place for coating the inner faces of the hollow spaces.

Figure 4:
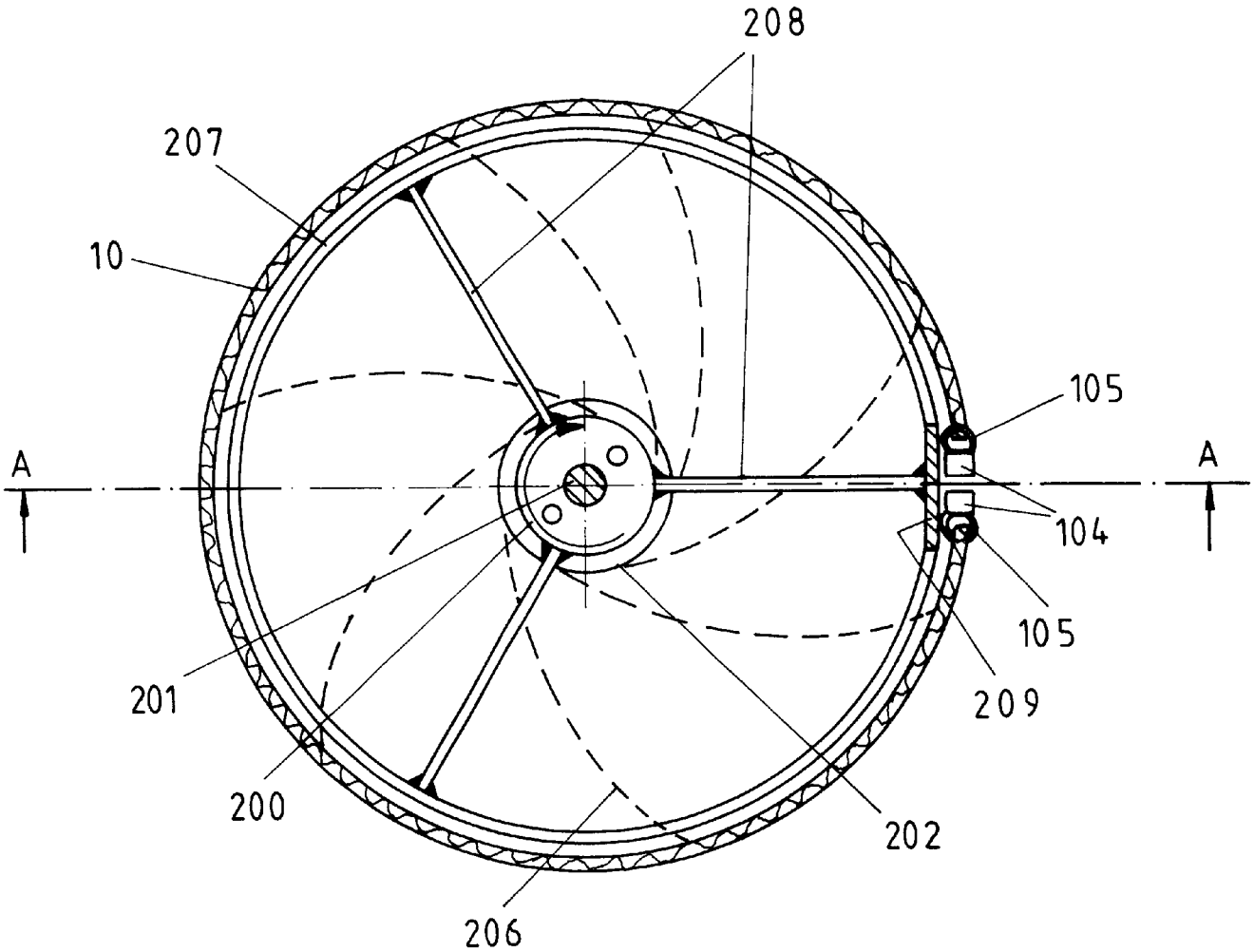
FIG. 4 is a top view of the hollow space according to FIG. 3.

FIG. 4 shows a topview of the mat 10 to be coated in the bent state represented in FIG. 3, the parts of the supporting frame being omitted. Furthermore, in FIG. 4, the spray device introduced into the cylindrical hollow space of the mat 10 is represented in form of a centrifugal emitter 200 for a two-component resin. Such a spray device is principally known and consists of a centrifugal wheel unit which is fixed at the end of a spindle 201 and which sprays the coating agent radially outwards over a centrifugal wheel disk 202. Furthermore, in FIG. 4, a spreader ring 207 can be seen which is connected with the spray device over braces 208 and which additionally secures the circular shape of the bent mat 10. The gap between the abutting mat front sides is covered by a segment spray protecting bracing 209 so that no coating means may escape or spoil the device. Said bracing 209 is fixed to the spreader ring 207 and protects the clamps which are on the bordering of the mat ends against dirt. The further structure of this device and the course of the wetting process will be described below with reference to FIG. 1 which represents a section along the line A—A-of FIG. 4.

Figure 1:
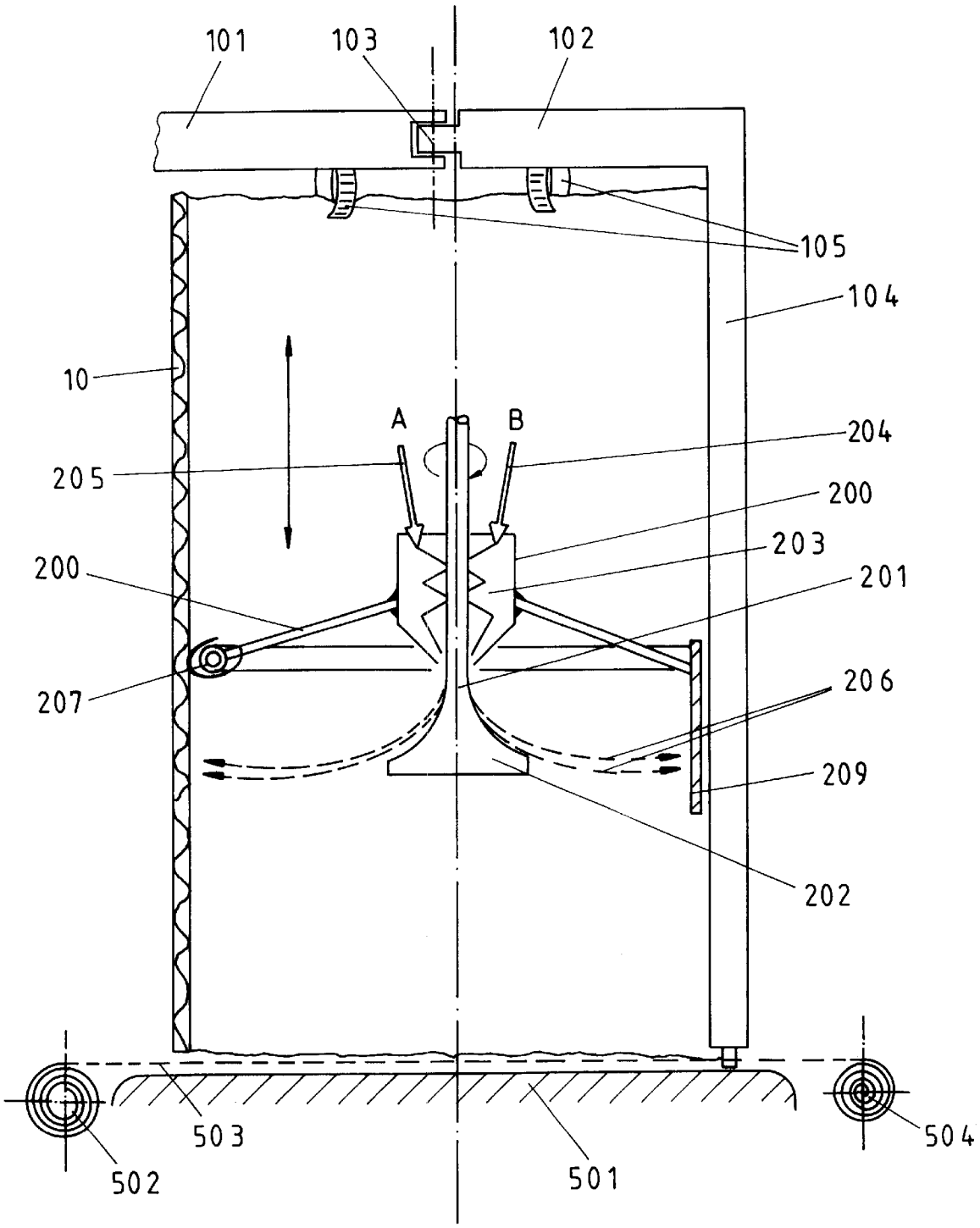
FIG. 1 shows a cross-section through a hollow space constituted by the frame and the mat to be coated with a spray device working therein along the line A—A of FIG. 4.

In the section according to FIG. 1, the segments 101 and 102 of the flexible side ledge as well as a rigid side ledge 104 of the frame can be seen. The mat 10 clamped into the frame is represented cut on the left side, while the intersection line of the figure coincides with the butt edge of both mat edges which is rolled up to a cylinder. The feeding pipe 205 for a first component (A) as well as the feeding pipe 204 for a second component (B) of the spray device 200 introduced along the vertical axis can be seen. Both components are mixed in the mixing area 203 and centrifuged outwards over the rotating centrifugal disk 202 with a radial motion component by constituting a spray jet 206. The ring-shaped wetting band in the spray area has a dispersion of only +/−2 cm. The lifting device for the spray device 200, the driving motor for the spindle 201 and the feeding hose pipes as well as the valves for the flow control of the components which are also on the unit 200 are not represented.

The wetting takes place during the upward movement of the spray device 200, since otherwise the spreader ring 207, which spreads the mat 10, had to be guided over already coated places and would spoil them. Due to an intended irregularity of the vertical movement of the centrifugal emitter 200, an axial irregularity of the wetting thickness (ring-shaped) can be achieved. Upon the end of the coating operation, the gripping frame takes its stretched normal position, swivels the wetted mat 10 again into the horizontal position and brings the mat to the next processing station which is generally a pressing tool.

The vertical orientation of the centrifugal emitter 200 sees to that the mat 10 is homogeneously coated, since the effect of the gravitation onto the spray jet 206 is the same at any place. This is a considerable advantage compared to the known coating methods in which the spray device 200 is guided horizontally. The vertical arrangement of the centrifugal emitter 200 is, as for the rest, also advantageous for its wetting with a cleaning agent, which is possible by simply immersing of the head into a container. This is generally necessary in case of interruptions or in pauses. In other arrangements, the spray head must be expressly swivelled for this purpose.

In order to process different mat widths, one or several articulated arms can be constructed slidable in order to change the distance of the clamps or hooks, eventually in an automatized process. The height of the mat 10 formed to a cylinder can, for example, be different from the length of the lateral grapplers or side ledges 104, i.e. be shorter or eventually also project downward up to 20%. Thus, mats with different big cut-outs can be processed without modifying the device itself.

Moreover, in FIG. 1, a platform 501 can be seen which is placed below the cylinder formed by the mat 10 and which is covered by a protecting foil 503 on its upper surface turned to the cylinder.

Here, the protecting foil can be pulled off from a supply roll 502 of a discharging device 504 for used protection foil. The installation of such a platform with a slowly moved "lost" foil protection is recommended for the protection against dirt (overspray in the border area, dripping of the spray device etc.), if the mat 10 has to be wetted at the lower end completely up to the border.

The device according to the invention guarantees in an ideal way the advantage of the low-pressure centrifugal resin applying, thus especially as little pollution as possible and minimal material losses by avoiding overspray, low expenses for protective and covering measures as well as lower expenses for suction measures or for air circulation. Due to the low air exchange, a hardly measurable influence of the hall heat demand also takes place.

In order to ensure different production outputs or cycle times, several drum gripping frames according to the invention and eventually several placed spray devices can be combined with each other in different configurations.

Figure 5:
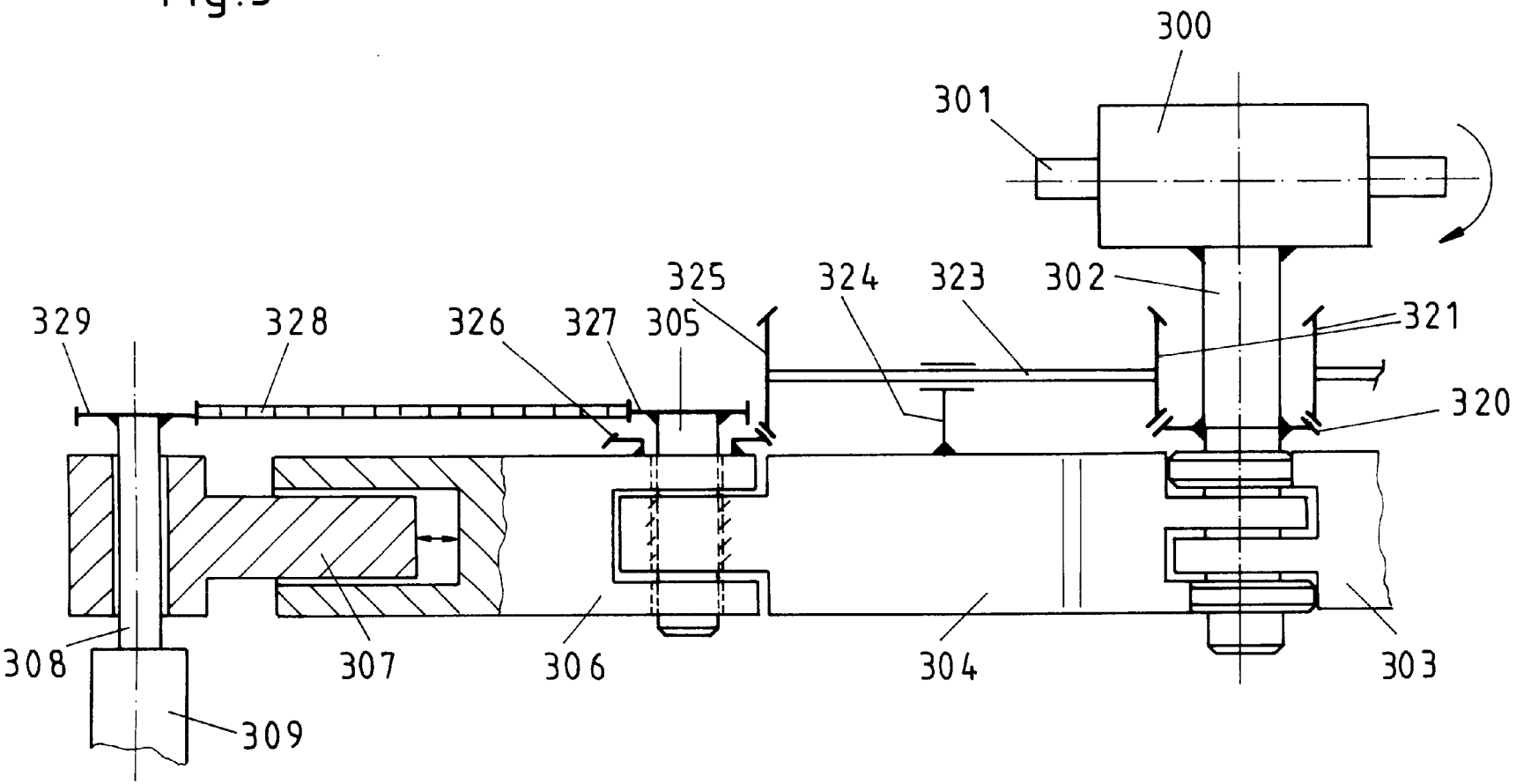
FIG. 5 shows a detail of the bending mechanism of the flexible ledge of the carrier frame.
Figure 6:
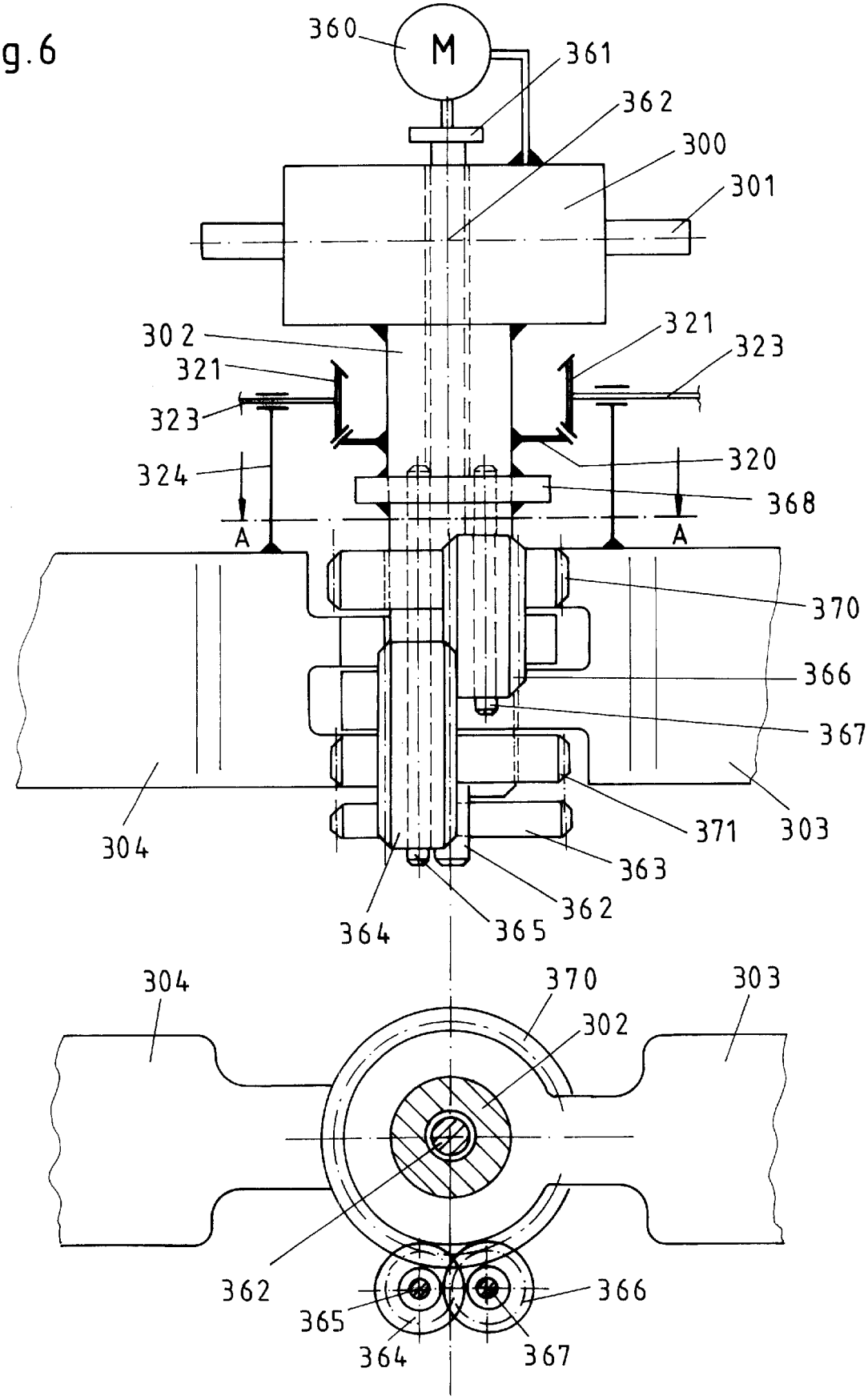
FIG. 6 shows a configuration of the bending mechanism with a central slewing gear.

A kinematic arrangement is shown in FIGS. 5 and 6 which allows to carry out the double bending process of the flexible side ledge of the frame by a single motor-driven gear. First, reference is made to the embodiment according to FIG. 5.

In FIG. 5, the swivelling mechanism of the flexible side ledge is represented in detail and partially as a section, the elements being designated, in spite of existing correspondences, with new reference numerals. A swinghead 300 can be seen which swivels about a horizontal swivelling axis 301. The inner right swivelling arm 303 and the inner left swivelling arm 304 are fixed to the vertical central axis 302 slewable to both sides. The outer swivelling arms, among which only the left outer swivelling arm is represented, are mounted on the ends of these swivelling arms and are connected by hinged articulations. An end piece 307 is mounted at the end of the outer swivelling arm, a lateral grappler 309 being fixed to this end piece by a swivelling axis 308 (compare FIG. 2, reference numeral 104). The inner swivelling arm 304 and the outer swivelling arm 306 are coupled over a hinge bolt 305 which is torsion-proof connected with the inner swivelling arm 304.

The movement coupling of the individual swivelling arms which takes place over gears will be described below. First, a conical toothed wheel 320 is coaxially connected with the central axis 302. This conical toothed wheel 320 cooperates with a further conical toothed wheel 321 which is mounted on the coupling shaft 323, running parallel to the inner swivelling arm 304, which is held by a bearing 324 placed on the inner swivelling arm 304. A further conical toothed wheel 325 for the power take-off is mounted at the other end of the coupling shaft 323. This conical toothed wheel 325 cooperates with a conical toothed wheel 326 which is torsion-proof connected with the outer swivelling arm 306 and which drives this arm. A rotation of the vertical central axis 302 is thus transformed by the mentioned mechanism into an angular displacement of the outer swivelling arm 306 relative to the inner swivelling arm 304. Due to the selection of the transmission between the conical toothed wheels 320 and 321 in the ratio 1:1 (angle □) and the conical toothed wheels 325 to 327=2:1 (angle □), the part 307 describes the double swivelling angle with respect to the part 304—relatively to the part 304.

Furthermore, a chain toothed wheel 327 is coaxially and torsion-proof placed on the hinge bolt 305, a driving chain 328 running over this wheel. This driving chain 328 is furthermore guided over a chain toothed wheel 329 which is connected with the swivelling axis 308 of the lateral grappler 309. A rotation of the bolt 305 causes a rotation movement of the grappler 309 over this mechanism. The swivelling axis 308 and the lateral grappler 309 are, in fact, generally fixedly connected with the end piece 307. But in this case, there are no transmission mechanisms 327 to 329 (chain toothed wheels and driving chain). However, in case a controlled deviation of the clamp orientation from the basic position is wished, this can be achieved in the way represented in FIG. 5 through the selection of an appropriate transmission ratio of toothed wheel 327 to toothed wheel 329.

The end piece 307 can be displaced relatively to the outer swivelling arm 306 in order to be able to adjust the device to different raw mat lengths. This length variation can also be performed automatically. Corresponding details such as for example a spindle drive with motor are not represented.

A configuration of the swivelling kinematics with a central swivelling gear is represented in FIG. 6. Here, all kinematic dependences are compulsory actuated with a single motor. Said motor 360 is fixed on the swinghead 300 and drives a coaxial primary shaft 362 over a shaft coupling 361. This shaft 362 is guided through the central swivelling shaft 302 downwards. A pinion 363, which is connected with the shaft, is mounted at the end of the swivelling shaft. The pinion drives again the intermediate toothed wheel 364 which is directly in gear into the edge indentation of the left inner swivelling arm 304 and which causes a pivoting of this part. Simultaneously, the intermediate toothed wheel 364 also drives the toothed wheel 366 of the same type which is in gear into the edge indentation of the right inner swivelling arm 303. Due to the reversal of the sense of rotation between the toothed wheels 364 and 366, the inner swivelling arms 303 and 304 execute the desired opposite movements. The remaining structure of the mechanism for the swivelling movement of the outer grapplers corresponds to that of FIG. 5.

| Reference numerals: | |
|---|---|
| 10 | Fiber mat |
| 100 | Swing head |
| 101 | Inner swivelling arm |
| 102 | Outer swivelling arm |
| 103 | Articulations |
| 104 | Side ledge |
| 105 | Clamps |

-continued

| Reference numerals: | |
|---|---|
| 108, 110 | Swivelling axis |
| 150 | Support |
| 190 | Swivelling angle α for the inner swivelling Arm 101 |
| 191 | Swivelling angle β for the outer swivelling arm 102 relatively to the inner swivelling arm 101 |
| 200 | Centrifugal emitter for two-component resin |
| 201 | Shaft of the centrifugal wheel unit |
| 202 | Centrifugal disk |
| 203 | Mixing area |
| 204 | Feeding of component (B) |
| 205 | Feeding of component (A) |
| 206 | Spray jet |
| 207 | Spreader ring |
| 208 | Brace |
| 209 | Segment spray protecting brace |
| 300 | Swinghead (see 100) |
| 301 | Horizontal swivelling axis (see 110) |
| 302 | Vertical central axis (see 108) |
| 303 | Inner swivelling arm right (see 101) |
| 304 | Inner swivelling arm left (see 101) |
| 305 | Hinge bolt torsion-proof connected with inner swivelling arm 304 |
| 306 | Left outer swivelling arm (see 102) |
| 307 | Displaceable end piece |
| 308 | Swivelling axis |
| 309 | Lateral grappler (see 104) |
| 320 | Conical toothed wheel connected with central axis 302 |
| 321 | Conical toothed wheel placed on coupling shaft 323 |
| 323 | Coupling shaft |
| 324 | Bearing for the coupling shaft, placed on inner swivelling arm 303/304 |
| 325 | Conical toothed wheel (take-off power) |
| 326 | Conical toothed wheel torsion-proof connected with 306 |
| 327 | Chain toothed wheel torsion-proof connected with hinge bolt 305 |
| 328 | Driving chain |
| 329 | Chain toothed wheel connected with swivelling axis 308 of the lateral gripping arm 309 |
| 360 | Driving motor |
| 361 | Shaft coupling |
| 362 | Coaxial driving shaft |
| 363 | Pinion |
| 364 | Intermediate toothed wheel 1 |
| 365 | Axis of intermediate toothed wheel 1 |
| 366 | Intermediate toothed wheel 2 |
| 367 | Axis of intermediate toothed wheel 2 |
| 368 | Bearing plate (torque bearing) for axis 365 and 367, fixedly connected with central shaft 302 |
| 370 | Indentation on the inner gripping arm 303 |
| 371 | Indentation on the inner gripping arm 304 |
| 501 | Platform |
| 502 | Supply roll for protecting foil |
| 503 | Stretched protecting foil |
| 504 | Discharging device for used protecting foil |

What is claimed is:

1. A method for wetting a flexible mat-shaped carrier material (10) comprising:

clamping the carrier material on to a carrier frame, bending a flexible side ledge (102,104) of the carrier frame such that the carrier material forms at least one generally cylindrical hollow shape, wetting, by spraying, the inner portion of the hollow shape.

2. A method according to claim 1, further comprising:

after the wetting step, producing a second generally cylindrical hollow shape by bending the flexible side ledge (102,104) of the carrier frame such that the carrier material forms the second generally cylindrical hollow shape, wherein the second generally cylindrical hollow shape has an opposite curvature than the at least one generally cylindrical hollow shape.

3. A method according to claim 1, wherein the axis of the at least one generally cylindrical hollow shape is oriented vertically.

4. A method according to claim 1, wherein an end piece (307) of the carrier frame is displaced length-wise, relative to an outer swiveling arm (306), such that the carrier frame adjusts for carrier materials of different lengths.

* * * * *